US011644787B2

(12) United States Patent
Pettingill

(10) Patent No.: US 11,644,787 B2
(45) Date of Patent: May 9, 2023

(54) CLUTCH MECHANISM FOR A DEVELOPMENT SYSTEM

(71) Applicant: HEWLETT-PACKARD DEVELOPMENT COMPANY, L.P., Spring, TX (US)

(72) Inventor: Justin Pettingill, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 24 days.

(21) Appl. No.: 17/594,505

(22) PCT Filed: Dec. 6, 2019

(86) PCT No.: PCT/US2019/065019

§ 371 (c)(1),
(2) Date: Oct. 20, 2021

(87) PCT Pub. No.: WO2021/112876

PCT Pub. Date: Jun. 10, 2021

(65) Prior Publication Data

US 2022/0206427 A1 Jun. 30, 2022

(51) Int. Cl.

| | |
|---|---|
| ***G03G 15/00*** | (2006.01) |
| ***G03G 21/16*** | (2006.01) |
| ***G03G 21/18*** | (2006.01) |

(52) U.S. Cl.

CPC ..... *G03G 15/758* (2013.01); *G03G 15/757* (2013.01); *G03G 21/1647* (2013.01); *G03G 21/1825* (2013.01); *G03G 2221/1657* (2013.01)

(58) Field of Classification Search

CPC ..... G03G 15/758; G03G 15/757; G03G 21/1647; G03G 21/1825; G03G 2221/1657; G03G 21/186

See application file for complete search history.

(56) References Cited

U.S. PATENT DOCUMENTS

| | | | | |
|---|---|---|---|---|
| 6,016,416 | A * | 1/2000 | Kitamura | G03G 15/757 399/167 |
| 7,769,326 | B2 | 8/2010 | Miyoshi | |
| 8,737,868 | B2 | 5/2014 | Tanabe | |
| 8,978,861 | B2 | 3/2015 | Bibby | |
| 2011/0170892 | A1* | 7/2011 | Ishida | G03G 21/1647 74/413 |
| 2012/0076526 | A1* | 3/2012 | Awano | G03G 21/1647 399/119 |

(Continued)

FOREIGN PATENT DOCUMENTS

| | | |
|---|---|---|
| JP | 1990291345 | 12/1990 |
| JP | H02291345 | 12/1990 |

(Continued)

*Primary Examiner* — Francis C Gray
(74) *Attorney, Agent, or Firm* — Foley & Lardner LLP

(57) ABSTRACT

A development system for an image forming apparatus includes a photosensitive drum having a drive plate to receive a driving force to rotate the photosensitive drum. The drive plate is provided on an end of the photosensitive drum. The development system also includes a developing roller having a clutch mechanism to dampen a force generated when the clutch mechanism engages the drive plate of the photosensitive drum. The clutch mechanism is provided on an end of the photosensitive drum.

15 Claims, 14 Drawing Sheets

(56) References Cited

U.S. PATENT DOCUMENTS

| | | | | |
|---|---|---|---|---|
| 2017/0293253 | A1 | 10/2017 | Iwase | |
| 2020/0310281 | A1* | 10/2020 | Haruta | G03G 21/1821 |
| 2021/0263462 | A1* | 8/2021 | Lee | G03G 21/1676 |
| 2021/0325811 | A1* | 10/2021 | Nakano | G03G 15/0808 |

FOREIGN PATENT DOCUMENTS

| | | | |
|---|---|---|---|
| JP | H06175494 | A | 6/1994 |
| JP | 1998232555 | | 9/1998 |
| JP | H10232555 | | 9/1998 |
| JP | 2006162833 | | 6/2006 |
| JP | 2007239964 | | 9/2007 |

* cited by examiner

CLUTCH MECHANISM FOR A DEVELOPMENT SYSTEM

BACKGROUND

An image forming apparatus forms an image on a recording medium, for example, in an electrophotographic manner. An image forming apparatus using the electrophotographic method supplies toner to an electrostatic latent image formed on a photoconductor to form a visible toner image on the photoconductor, transfers the toner image to the recording medium via an intermediate transfer medium or directly to a recording medium, and then fixes the transferred toner image on the recording medium.

A development system may include a development cartridge capable of being detachably attached to the image forming apparatus. The development cartridge may include an assembly of elements for forming the visible toner image. The development cartridge may be detachably attached to a main body of the image forming apparatus and be a consumable item that is replaced when its service life is over. In a development cartridge using a contact development method, a developing roller and a photoconductor contact each other, thereby forming a development nip.

DETAILED DESCRIPTION

Figure 1:
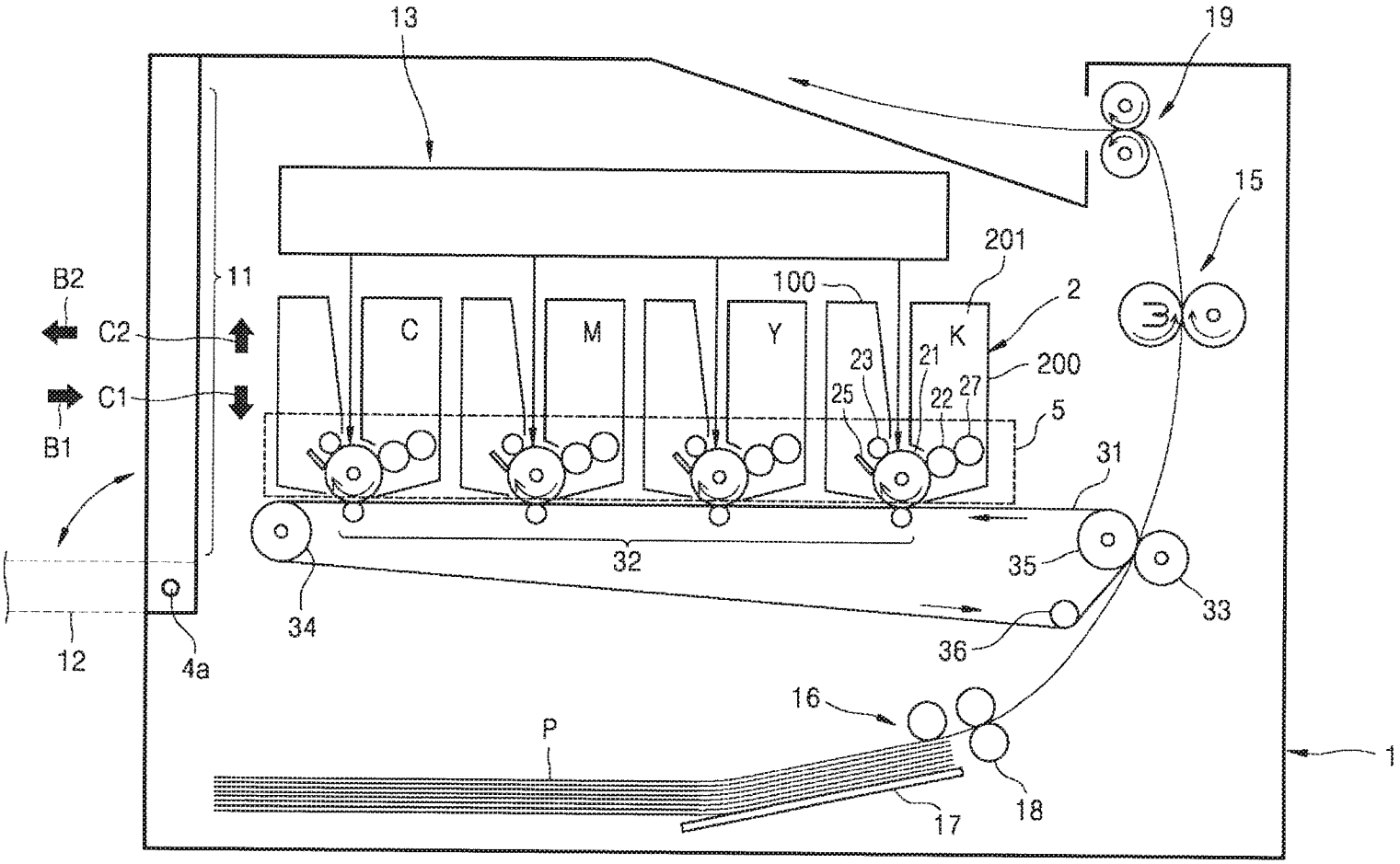
FIG. 1 is a schematic configuration diagram illustrating an image forming apparatus according to an example.

Hereinafter, examples of an electrophotographic image forming apparatus and a development system having a development cartridge will be described in detail with reference to the accompanying drawings. Elements having substantially the same configurations are denoted by the same reference numerals in the specification and the accompanying drawings, and thus, a repeated description thereof is omitted.

According to the disclosure, a development system includes a photosensitive unit including a photosensitive drum, a developing unit including a developing roller, the developing unit being coupled to the photosensitive unit such that the developing unit is movable to a development position where a development nip forms by contact between the developing roller and the photosensitive drum and is movable to a release position where the development nip is released, and a pressurizing unit to be shifted to a first position where the pressurizing unit applies an elastic force to the developing unit in a direction such that the developing unit is maintained in the development position, and is shifted to a second position where the pressurizing unit applies an elastic force to the developing unit in a direction such that the developing unit is maintained in the release position.

According to the disclosure, the photosensitive drum may include a drive plate to receive a driving force to rotate the photosensitive drum, the drive plate being provided on an end of the photosensitive drum. The developing roller may have a clutch mechanism to dampen a force generated when the clutch mechanism engages the drive plate of the photosensitive drum, the clutch mechanism being provided on an end of the developing roller.

According to the disclosure, an image forming apparatus may include a main body, and the above-described development system, which may be detachable from the main body.

FIG. 1 is a schematic configuration diagram illustrating an electrophotographic image forming apparatus, according to an example. An image forming apparatus according to the example prints a color image to a recording medium P in an electrophotographic manner. Referring to FIG. 1, the image forming apparatus may include a main body 1, a plurality of development cartridges 2, an exposure device 13, a transfer device, and a fuser 15.

For color printing, the plurality of development cartridges 2 may include four development cartridges 2 for developing images with cyan color, magenta color, yellow color, and black color, respectively. Toners, of cyan (C) color, magenta (M) color, yellow (Y) color, and black (K) color may be contained in the four development cartridges 2, respectively. Although not illustrated, the toners of cyan color, magenta color, yellow color, and black color may be respectively contained in four toner supply containers, and may be respectively supplied from the four toner supply containers to the four development cartridges 2. The image forming apparatus may further include development cartridges 2 for containing and developing toners of other various colors such as light magenta color and white color. Hereinafter, unless there is a particular description contrary thereto, items with reference characters C, M, Y, and K indicate elements for developing images with cyan color, magenta color, yellow color, and black color, respectively.

The main body 1 includes an opening 11 that provides a path for mounting/detaching the plurality of development cartridges 2. A cover 12 opens and closes the opening 11. The exposure device 13, the transfer device, and the fuser 15 are arranged at the main body 1. In addition, a recording medium transport unit for loading and transporting the recording medium P where an image is to be formed is arranged at the main body 1.

In the example, each of the plurality of development cartridges 2 is an integrated development cartridge. Each development cartridge 2 may include a photosensitive unit 100 and a developing unit 200.

The photosensitive unit 100 includes a photosensitive drum 21. The photosensitive drum 21. The photosensitive drum 21, as a photoconductor or organic photoconductor on which an electrostatic latent image is formed, may include a conductive metal pipe and a photosensitive layer formed at an outer circumference of the conductive metal pipe. A charging roller 23 is an example of a charger that charges a surface of the photosensitive drum 21 to have a uniform surface potential. Instead of the charging roller 23, a charging brush, a corona charger, or the like may be used. The photosensitive unit 100 may further include a cleaning roller (not shown) for removing foreign substances attached to a surface of the charging roller 23. A cleaning blade 25 is an example of a cleaning member that removes residual toners and foreign substances attached to the surface of the photosensitive drum 21 after a transfer process described below. Instead of the cleaning blade 25, a cleaning device in another form, such as a rotating brush, may be used.

The developing unit 200 includes a toner container 201. The developing unit 200 supplies a toner in the toner container 201 to an electrostatic latent image formed on the photosensitive drum 21, thereby developing the electrostatic latent image into a visible toner image. A developing method may include a one-component developing method using a toner and a two-component developing method using a toner and a carrier. In the example, the developing unit 200 employs the one-component developing method. A developing roller 22 supplies a toner to the photosensitive drum 21. A developing bias voltage may be applied to the developing roller 22 to supply the toner to the photosensitive drum 21.

The one-component developing method may be classified into a contact development technique in which the developing roller 22 and the photosensitive drum 21 rotate while contacting each other and a non-contact development technique in which the developing roller 22 and the photosensitive drum 21 rotate while being separate from each other by tens to hundreds of microns. In the example, a contact development technique in which the developing roller 22 and the photosensitive drum 21 contact each other and thus form a development nip N is used. A supply roller 27 supplies the toner in the toner container 201 to a surface of the developing roller 22. To this end, a supply bias voltage may be applied to the supply roller 27. The developing unit 20 may further include a regulating member (not shown) for regulating an amount of toner to be supplied by the developing roller 22 to the development nip N where the photosensitive drum 21 and the developing roller 22 contact each other. For example, the regulating member may be a doctor blade that elastically contacts the surface of the developing roller 22.

The exposure device 13 radiates light modulated in correspondence with image information onto the photosensitive drum 21 and thus forms the electrostatic latent image on the photosensitive drum 21. Examples of the exposure device 13 may include a laser scanning unit (LSU) using a laser diode as a light source and a light-emitting diode (LED) exposure device using an LED as a light source.

The transfer device may include an intermediate transfer belt 31, first transfer rollers 32, and a second transfer roller 33. The intermediate transfer belt 31 temporarily receives a toner image developed on the photosensitive drum 21 of each of the development cartridges 2C, 2M, 2Y, and 2K. The intermediate transfer belt 31 is circulated while being supported by supporting rollers 34, 35, and 36. Four first transfer rollers 32 are positioned to face the photosensitive drums 21 of the development cartridges 2C, 2M, 2Y, and 2K with the intermediate transfer belt 31 therebetween. A first transfer bias voltage is applied to the four first transfer rollers 32 to firstly transfer toner images, which are developed on the photosensitive drums 21, to the intermediate transfer belt 31. Instead of the first transfer rollers 32, a corona transfer device or a pin scorotron-type transfer device may be used. The second transfer roller 33 is positioned to face the intermediate transfer belt 31. A second transfer bias voltage is applied to the second transfer roller 33 to transfer, to the recording medium P, the toner images that are firstly-transferred to the intermediate transfer belt 31.

When a print command is transmitted from a host (not shown), etc., a controller 300 charges, by using the charging roller 23, the surface of the photosensitive drum 21 to have a uniform surface potential. The exposure device 13 forms electrostatic latent images on the photosensitive drums 21 by scanning four light beams to the photosensitive drums 21 of the development cartridges 2C, 2M, 2Y, and 2K, the four light beams being modulated according to image information corresponding to cyan, magenta, yellow, and black colors, respectively. The developing rollers 22 of the development cartridges 2C, 2M, 2Y, and 2K supply C, M, Y, and K toners to the photosensitive drums 21, respectively, thereby developing the electrostatic latent images into visible toner images. The developed toner images are firstly transferred to the intermediate transfer belt 31. Recording media P loaded on a loading plate 17 are output one by one by a pick-up roller 16, and are transported to a transfer nip by a feed roller 18, the transfer nip being formed by the second transfer roller 33 and the intermediate transfer belt 31. The toner images that are firstly-transferred to the intermediate transfer belt 31 are secondly transferred to the recording medium P due to the second transfer bias voltage applied to the second transfer roller 33. When the recording medium P passes through the fuser 15, the toner images are fixed on the recording medium P due to heat and pressure. The recording medium P on which fixing has been completed is externally discharged by a discharge roller 19.

The development cartridges 2C, 2M, 2Y, and 2K may be sequentially detachably attached to the main body 1 through the opening 11 opened by the door 12. That is, the plurality of development cartridges 2 may be mounted on the main body 1 by opening the door 12 and causing the development cartridges 2 to slide in a mounting direction B1. Also, the development cartridges 2 may be detached from the main body 1 by opening the door 12 and causing the development cartridges 2 to slide in a removal direction B2.

The development cartridges 2C, 2M, 2Y, and 2K may be mounted on the main body 1 in a tray manner. The main body 1 includes a tray 5 which is loaded with the development cartridges 2C, 2M, 2Y, and 2K which can be inserted into the main body 1 and retracted from the main body 1. For example, after the door 12 is opened, and the tray 5 is brought out of the main body 1 by causing the tray 5 to slide in the removal direction B2, the development cartridges 2C, 2M, 2Y, and 2K may be loaded on the tray 5. Next, the tray 5 may be inserted into the main body 1 by causing the tray 5 to slide in the mounting direction B1, and the door 12 may be closed.

Figure 2:
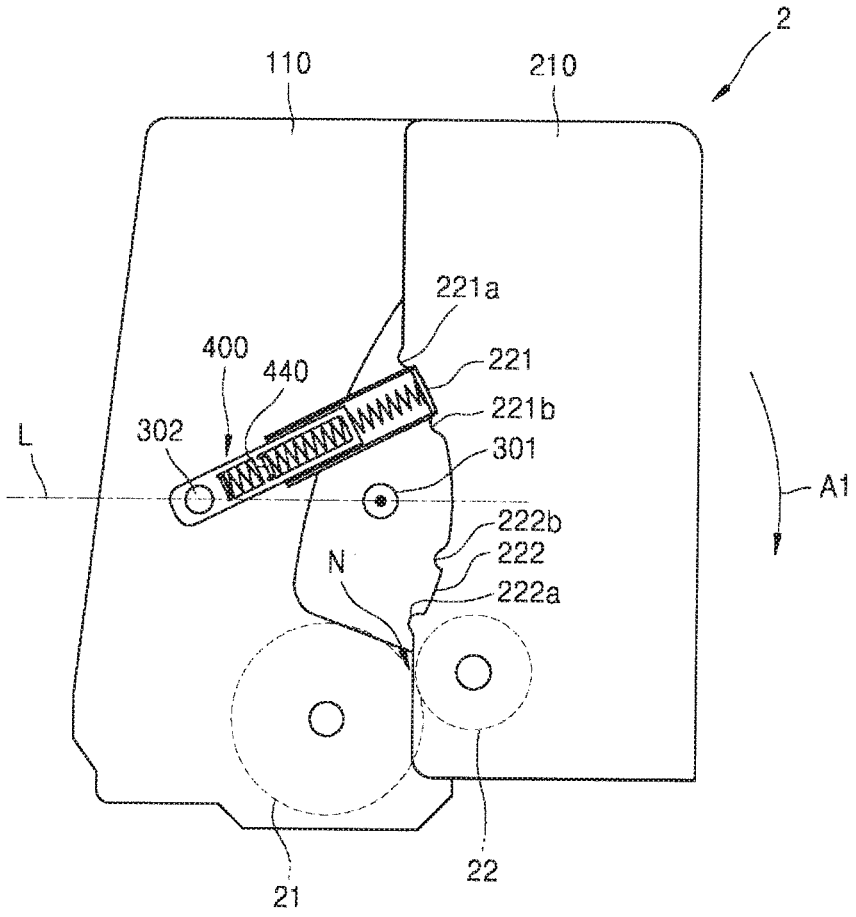
FIG. 2 is a side view of a development cartridge according to an example, which illustrates a state in which a photosensitive drum and a developing roller contact each other to form a development nip.
Figure 3:
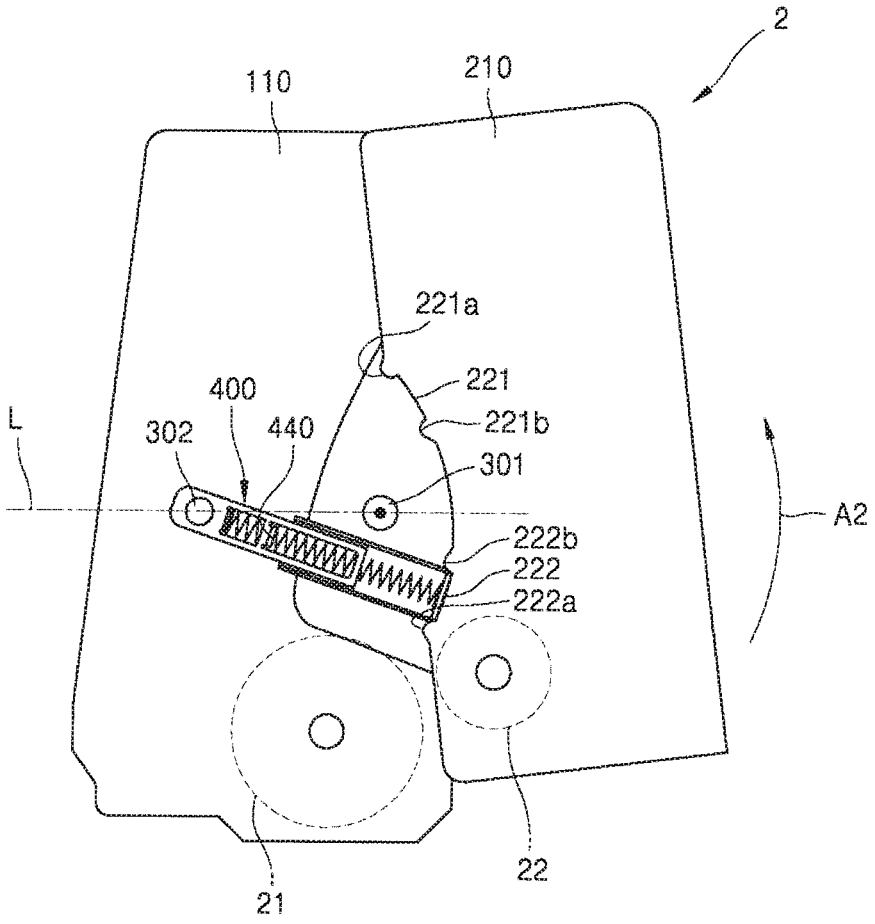
FIG. 3 is a side view of a development cartridge according to an example, which illustrates a state in which a photosensitive drum and a developing roller are separated from each other to release a development nip.

FIGS. 2 and 3 are side views illustrating the development cartridge 2 according to an example. FIG. 2 illustrates a state in which the photosensitive drum 21 and the developing roller 22 contact each other to form the development nip N. In this state, the developing roller 22 and photosensitive drum 21 may be referred to as being in a printing orientation where the developing roller 22 is in a printing or development or first position for the operation of printing. FIG. 3 illustrates a state in which the photosensitive drum 21 and the developing roller 22 are separated from each other to release the development nip N. In this state, the developing roller 22 and photosensitive drum 21 may be referred to as being in an alienation orientation where the developing roller 22 is in an alienation or release or second position so as to be separated from the photosensitive drum 21 in a non-printing position. The developing roller 22 and photosensitive drum 21 may be set to the alienation orientation to reduce wear and tear of these components which may be caused due to friction between the developing roller 22 and photosensitive drum 21. The developing roller 22 and photosensitive drum 21 may be set to the alienation orientation when the image forming apparatus is not in use, when the image forming apparatus is to be transported, or when the image forming apparatus is to be powered off, for example. The developing roller 22 and photosensitive drum 21 may be set to the alienation orientation when the development cartridge 2 is not in use, when the development cartridge 2 is to be transported, or when development cartridge 2 is to be removed from or inserted into the image forming apparatus, for example.

Referring to FIGS. 2 and 3, the development cartridge 2 includes the photosensitive unit 100 and the developing unit 200. The photosensitive unit 100 includes a first frame 110 and the photosensitive drum 21 is supported by the first frame 110. The developing unit 200 includes a second frame 210 and the developing roller 22 is supported by the second frame 210. The developing unit 200 is coupled to the photosensitive unit 100 to be rotatable to the development position (FIG. 2) in which the photosensitive drum 21 and the developing roller 22 contact each other to form the development nip N and a release position (FIG. 3) in which the photosensitive drum 21 and the developing roller 22 are separated from each other to release the development nip N. For example, the developing unit 200 is coupled to the photosensitive unit 100 to be rotatable to the development position and the release position with respect to a hinge shaft 301.

The development cartridge 2 further includes a pressurizing unit 400. The pressurizing unit 400 is installed at the photosensitive unit 100 and elastically presses the developing unit 200. A rotation direction of the developing unit 200 is determined according to a position of a portion pressed by the pressurizing unit 400. The developing unit 200 includes first and second pressing portions 221 and 222. The pressurizing unit 400 may move to a first position for pressing the first pressing portion 221 and a second position for pressing the second pressing portion 222. For example, the pressurizing unit 400 is mounted on a rotation shaft 302 provided in the photosensitive unit 100 to be rotatable to the first and second positions. The first position is a position for pressing the first pressing portion 221 and rotating the developing unit 200 with respect to the hinge shaft 301 in a first direction A1 for forming the development nip N, and the second position is a position for pressing the second pressing portion 222 and rotating the developing unit 200 with respect to the hinge shaft 301 in a second direction A2 for releasing the development nip N. The pressurizing unit 400 applies an elastic force in a direction of maintaining the developing unit 200 in the development position to the developing unit 200 at the first position and applies an elastic force in a direction of maintaining the developing unit 200 in the release position to the developing unit 200 at the second position.

The first pressing portion 221 is at an opposite side to that of the developing roller 22, based on a line L connecting the rotation shaft 302 and the hinge shaft 301 to each other, and the second pressing portion 222 is at the same side as the developing roller 22, based on the line L. A first stopper 221*a* prevents the pressurizing unit 400 from rotating beyond the first pressing portion 221. A second stopper 222*a* prevents the pressurizing unit 400 from rotating beyond the second pressing portion 222. A first position determiner 221*b* is at an opposite side to that of the first stopper 221*a* based on a rotation direction of the pressurizing unit 400 and maintains the pressurizing unit 400 in the first position. A second position determiner 222*b* is at an opposite side to that of the second stopper 222*a* based on the rotation direction of the pressurizing unit 400 and maintains the pressurizing unit 400 in the second position. While being elastically compressed towards the rotation shaft 302, the pressurizing unit 400 may rotate to the second position or the first position beyond the first and second position determiners 221*b* and 222*b*. The pressurizing unit 400 includes an interference lever 440 which may be interfered with by an operating portion (not shown) of the main body 1 when the development cartridge 2 is loaded on the tray 1 and mounted on the main body 1, such that the pressurizing unit 400 is rotated from the second position to the first position with respect to the rotation shaft 302.

As illustrated in FIG. 2, in a state in which the pressurizing unit 400 is at the first position, the pressing member 420 contacts and pushes the first pressing portion 221. A direction of an elastic force applied to the first pressing portion 221 by the pressurizing unit 400 is a direction of forming the development nip N. That is, the developing unit 200 is elastically biased to rotate in the first direction A1 by an elastic force of the pressurizing unit 400 in the first position. The development nip N may be maintained in a formed state by the elastic force of the pressurizing unit 400.

Thus, when the pressurizing unit 400 is at the first position, the pressurizing unit 400 provides a maintaining force maintaining the development nip N to the developing unit 200. Until the pressurizing unit 400 reaches the line L from the first position, the maintaining force is continuously provided to the developing unit 200. Accordingly, in spite of external shock applied to an image forming apparatus or operation shock of an image forming apparatus, the development nip N may be stably maintained in a formed state, and thus, stable image quality may be obtained.

As illustrated in FIG. 3, in a state in which the pressurizing unit 400 is at the second position, a direction of an elastic force applied to the second pressing portion 222 by the pressurizing unit 400 is a direction of releasing the development nip N. That is, the developing unit 200 is elastically biased to rotate in the second direction A2 by an elastic force of the pressurizing unit 400 in the second position. Accordingly, the development nip N may be maintained in a released state by the elastic force of the pressurizing unit 400.

Thus, when the pressurizing unit 400 is at the second position, the pressurizing unit 400 provides a releasing force releasing the development nip N to the developing unit 200. Until the pressurizing unit 400 reaches the line L from the second position, the releasing force is continuously provided to the developing unit 200. Accordingly, the development nip N may be stably maintained in a released state even during a process of providing the development cartridge 2 for manufacture, transport, and sales, and thus, deformation or destruction of the developing roller 22 and/or the photosensitive drum 21 may be reduced.

Through the above-described configuration, by moving the pressurizing unit 400 provided in the development cartridge 2 to the first and second positions, the development nip N may be easily formed/released.

A coupling form of the developing unit 200 and the photosensitive unit 100 is not limited to the examples described above. As another example, the developing unit 200 may be coupled to the photosensitive unit 100 to be slidable to a development position where the development nip N is formed and a release position where the development nip N is released.

Figure 4:
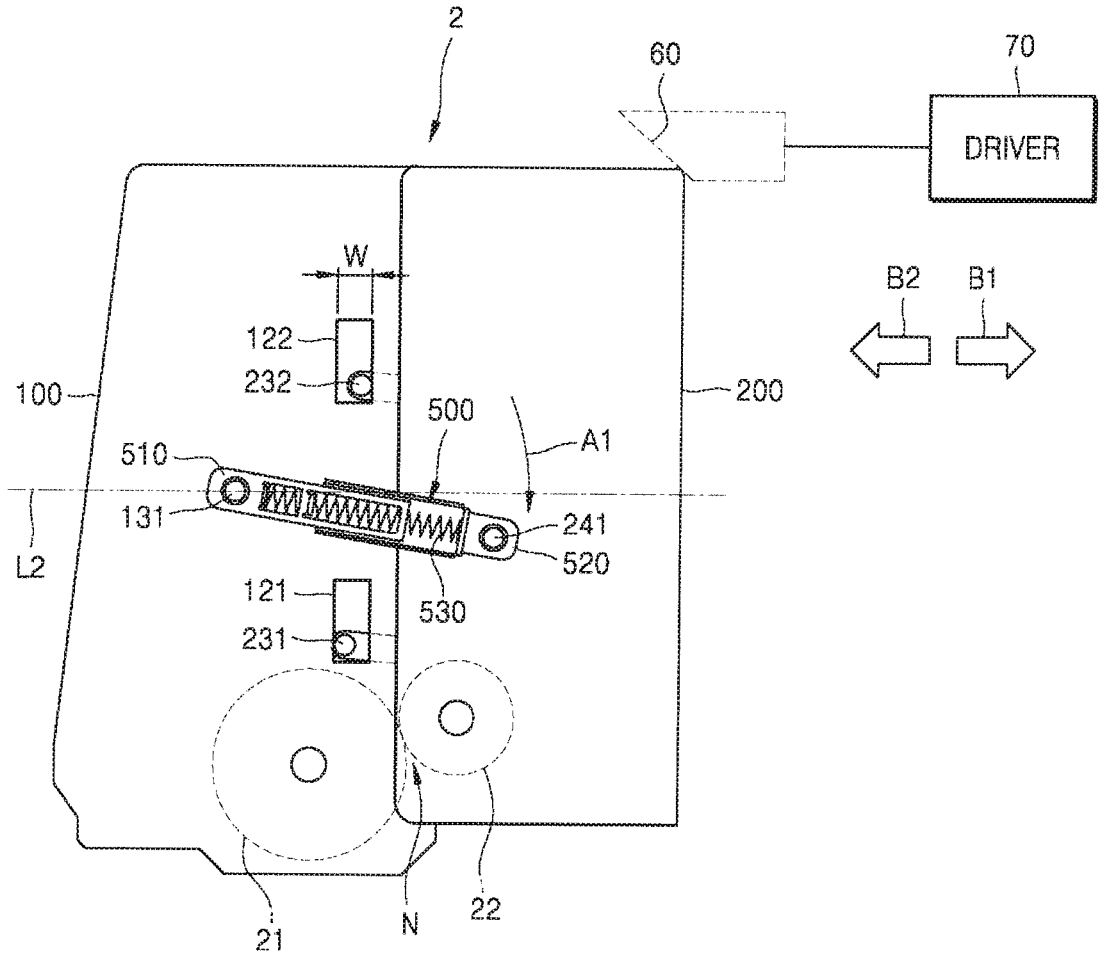
FIG. 4 is a schematic configuration diagram of an image forming apparatus according to an example, which illustrates a state in which a developing unit is in a development position.
Figure 5:
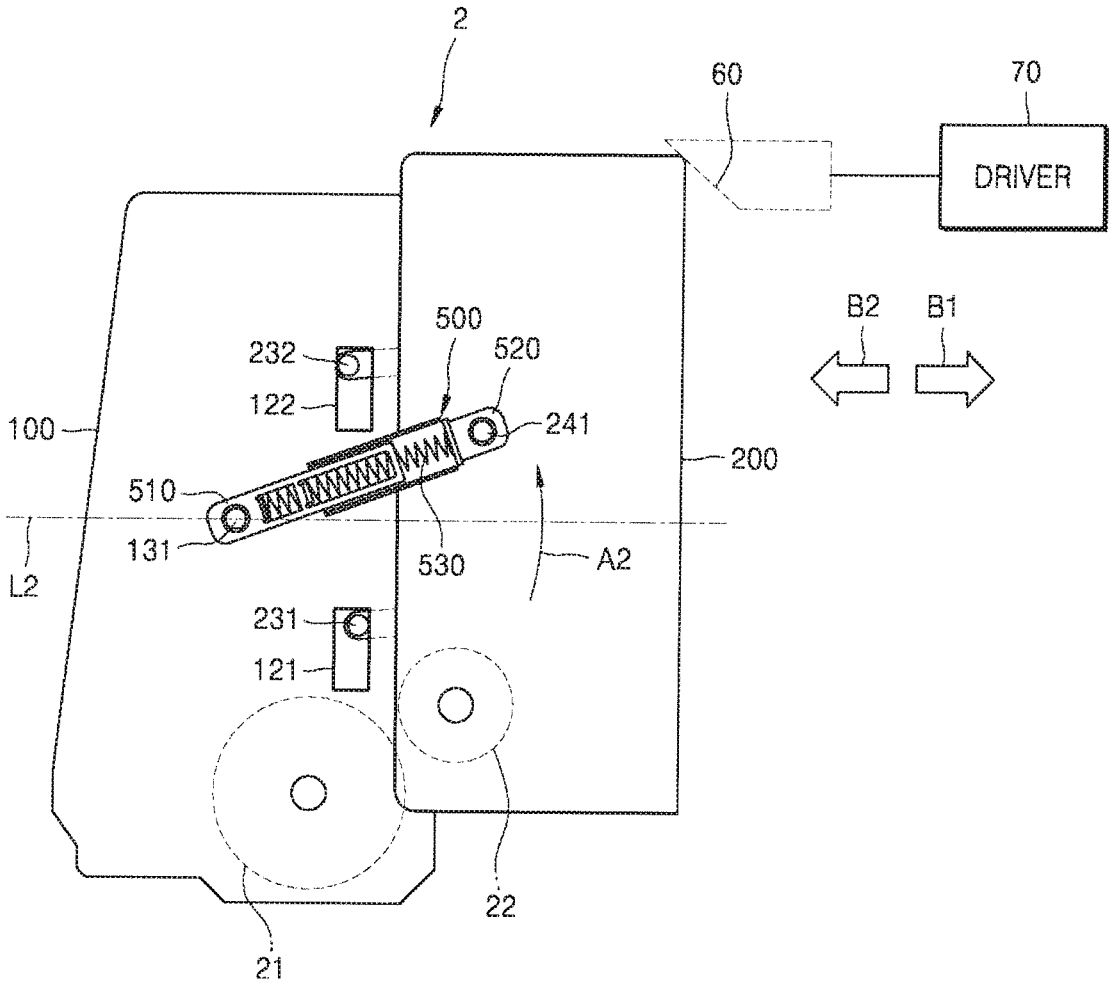
FIG. 5 is a schematic configuration diagram of an image forming apparatus according to an example, which illustrates a state in which a developing unit is in a release position.

FIGS. 4 and 5 are schematic configuration diagrams of an image forming apparatus according to an example, in which FIG. 4 illustrates a state in which the developing unit 200 is in a development position, and FIG. 5 illustrates a state in which the developing unit 200 is in a release position.

Referring to FIGS. 4 and 5, the developing unit 200 is coupled to the photosensitive unit 100 to be slidable to a development position (FIG. 4) where the photosensitive drum 21 and the developing roller 22 contact each other to form the development nip N and a release position (FIG. 5) where the photosensitive drum 21 and the developing roller 22 are separated from each other to release the development nip N. For example, the photosensitive unit 100 includes first and second guide slots 121 and 122, and the developing unit 200 includes first and second guide protrusions 231 and 232 respectively inserted into the first and second guide slots 121 and 122. The first and second guide slots 121 and 122 extend in a sliding direction of the developing unit 200 and are separate from each other in the sliding direction. A width W of the first and second guide slots 121 and 122 in a direction perpendicular to the sliding direction is a little greater than a width, for example, a diameter, of the first and second guide protrusions 231 and 232. Thus, the developing unit 200 may slide along the first and second guide slots 121 and 122, and at the same time, may rotate slightly.

The development cartridge 2 further includes the pressurizing unit 500. The pressurizing unit 500 may include a first rotation member 510, a second rotation member 520, and an elastic member 530. The first rotation member 510 includes a first hinge hole into which a first rotation shaft 131 provided in the photosensitive unit 100 is inserted, such that the first rotation member 510 may rotate around the first rotation shaft 131 via the first hinge hole. The second rotation member 520 includes a second hinge hole into which a second rotation shaft 241 provided in the developing unit 200 is inserted, such that the second rotation member 520 may rotate around the second rotation shaft 241 via the second hinge hole. The first and second rotation members 510 and 520 are elastically slidably connected between the first and second rotation shafts 131 and 241.

The pressurizing unit 500 has a first position (FIG. 4) where an elastic force is applied to the developing unit 200 to slide in a direction of forming the development nip N and a second position (FIG. 5) where an elastic force is applied to the developing unit 200 to slide in a direction of releasing the development nip N. At the first position, the developing unit 200 is in the development position, and at the second position, the developing unit 200 is in the release position. Based on a line L2 passing through the first rotation shaft 131 and perpendicular to an extending direction of the first and second guide slots 121 and 122, that is, a sliding direction of the developing unit 200, the second rotation shaft 241 is at the same side as the developing roller 22 at the first position and is at an opposite side thereof at the second position. Through the above-described configuration, elastic forces of the pressurizing unit 500 applied when the pressurizing unit 500 is at the first and second positions respectively work in a direction of forming and maintaining the development nip N and in a direction of releasing the development nip N.

As illustrated in FIG. 4, in a state in which the pressurizing unit 500 is at the first position, an elastic force of the pressurizing unit 500 is applied in a direction of causing the developing unit 200 to slide downwards. Accordingly, the development nip N may be maintained in a formed state by the elastic force of the pressurizing unit 500.

As illustrated in FIG. 5, in a state in which the pressurizing unit 500 is at the second position, a direction of an elastic force applied to the developing unit 200 by the pressurizing unit 500 is a direction of releasing the development nip N. When the developing unit 200 slides in a direction in which the developing roller 21 approaches the photosensitive drum 21, the elastic force of the pressurizing unit 500 is maintained in the direction of releasing the development nip N until the pressurizing unit 500 rotates and reaches the line L2.

When the developing unit 200 further slides, and thus, the pressurizing unit 500 rotates beyond the line L2, the direction of the elastic force of the pressurizing unit 500 is shifted to a direction of causing the developing unit 200 to slide in the direction in which the developing roller 22 approaches the photosensitive drum 21. Accordingly, due to the elastic force of the pressurizing unit 500, the developing unit 200 more easily slides in the direction in which the developing roller 22 approaches the photosensitive drum 21.

When the pressurizing unit 500 reaches the first position, the developing roller 22 may contact the photosensitive drum 21 to form the development nip N as illustrated in FIG. 4, and the development nip N may be maintained in a formed state by the elastic force of the pressurizing unit 500.

Through the above-described configuration, the pressurizing unit 500 provided in the development cartridge 2 itself may be shifted to the first and second positions by causing the developing unit 200 to slide with respect to the photosensitive unit 100, and thus, the development nip N may be easily formed/released.

In the above-described example, a structure in which the photosensitive unit 100 includes first and second guide slots and the developing unit 200 includes first and second guide protrusions is employed. However, a structure in which the developing unit 200 includes first and second guide slots and the photosensitive unit 100 includes first and second guide protrusions may also be employed. The number of each of a guide slot and a guide protrusion is not limited to 2, and three or more may be provided.

As denoted by dashed lines in FIGS. 4 and 5, the main body 1 includes an operating portion 60 which may interfere with the developing unit 200. Referring to FIG. 5, when the development cartridge 2 is mounted on the main body 1, the operating portion 60 interferes with the developing unit 200 positioned in a release position and thus guides the developing unit 200 to move in a direction in which the developing roller 22 approaches the photosensitive drum 21. For example, the operating portion 60 may be inclined downwards in the mounting direction B1. When the development cartridge 2 is mounted on the main body 1 in a state in which the pressurizing unit 500 is at the second position, the developing unit 200 is guided by the operating portion 60 to move in the direction in which the developing roller 22 approaches the photosensitive drum 21, and the pressurizing unit 500 is rotated from the second position to the first position with respect to the first and second rotation shafts 131 and 241. When the pressurizing unit 500 reaches the first position as illustrated in FIG. 4, the development nip N is formed.

A structure in which the development cartridge 2 is mounted on the main body 1 and then the operating portion 60 is moved in the mounting direction B1 or the removal direction B2 to rotate the pressurizing unit 500 to the first and second positions may be employed. Referring to FIGS. 4 and 5, for example, the operating portion 60 has a structure capable of, while moving in the removal direction B2, interfering with the developing unit 200 and causing the developing unit 200 to slide, thereby rotating the pressurizing unit 500 in the second position to the first position. For example, the operating portion 60 may be inclined downwards in the mounting direction B1. Through the above-described configuration, after the development cartridge 2 is mounted on the main body 1 in a state in which the pressurizing unit 500 is at the second position, the pressurizing unit 500 may be rotated from the second position to the first position while the operating portion 60 is moved in the removal direction B2. The mounting portion 60 may be moved in conjunction with a closing operation of the door 12, and may be moved by a driver 70. The driver 70 may be implemented, for example, by a linear motor, a solenoid actuator, or a rotary motor and a converter for converting rotary movement of the rotary motor into reciprocal movement of the operating portion 60.

Figure 6:
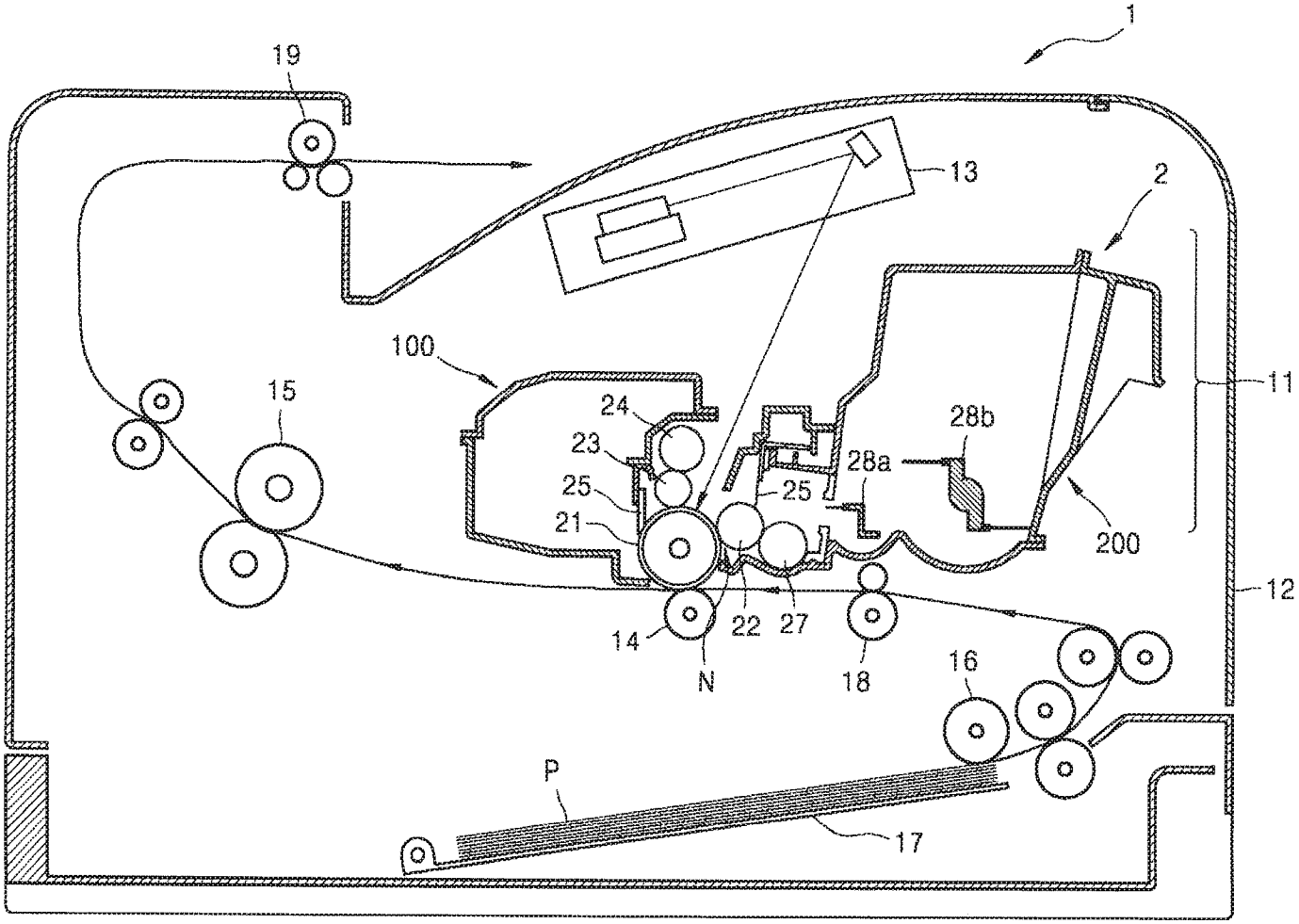
FIG. 6 is a schematic configuration diagram illustrating an image forming apparatus according to an example.

FIG. 6 is a schematic configuration diagram illustrating an image forming apparatus according to an example. The image forming apparatus according to the example is a single-color image forming apparatus. In FIG. 6, elements performing the same functions as those of the image forming apparatus illustrated in FIG. 1 are denoted by the same reference numerals, and a repeated description thereof is omitted.

The development cartridge 2 includes the photosensitive unit 100 and the developing unit 200. The photosensitive unit 100 includes the photosensitive drum 21 and the charging roller 23. Reference numeral 24 denotes a cleaning roller for removing foreign substances attached on the charging roller 23. The developing unit 200 includes the developing roller 22 and the supply roller 27. First and second agitators 28*a* and 28*b* for stirring toner and carrying toner to the supply roller 27 may be arranged in the toner container 201. Reference numeral 25 denotes a regulating member for regulating an amount of toner which is attached to the developing roller 22 and is supplied to the development nip N.

A transfer roller 14 faces the photosensitive drum 1, and the recording medium P is transported between the photosensitive drum 21 and the transfer roller 14.

Through the above-described configuration, the exposure device 13 forms an electrostatic latent image by scanning light modulated according to image information to the photosensitive drum 21. The developing roller 22 forms a visible toner image on a surface of the photosensitive drum 21 by supplying toner to the electrostatic latent image. The recording medium P loaded on the loading plate 17 is transported to an area where the photosensitive drum 21 and the transfer roller 14 face each other by the pick-up roller 16 and the feed roller 18, and the toner image is transferred from the photosensitive drum 21 to the recording medium P by a transfer bias voltage applied to the transfer roller 14. When the recording medium P passes through the fuser 15, the toner image is fixed on the recording medium P due to heat and pressure. The recording medium P on which fixing has been completed is discharged by the discharge roller 19.

FIGS. 2 through 5 described example structures by which the developing roller 22 may be moved so as to contact the photosensitive drum 21 to form the development nip N, so that the developing roller 22 and photosensitive drum 21 are arranged in a printing orientation where the developing roller 22 is in a printing or development or first position for the operation of printing.

FIGS. 2 through 5 also described example structures by which the developing roller 22 may be moved so as to be spaced apart from the photosensitive drum 21 to release the development nip N, so that the developing roller 22 and photosensitive drum 21 are arranged in an alienation orientation where the developing roller 22 is in an alienation or release or second position so as to be separated from the photosensitive drum 21 in a non-printing position. The example structures illustrated in FIGS. 2 through 5 may be applied to the image forming apparatus of FIG. 1 as well as the image forming apparatus of FIG. 6. Further, the example structures illustrated in FIGS. 2 through 5 may be applied to other kinds of image forming apparatuses.

Figure 7:
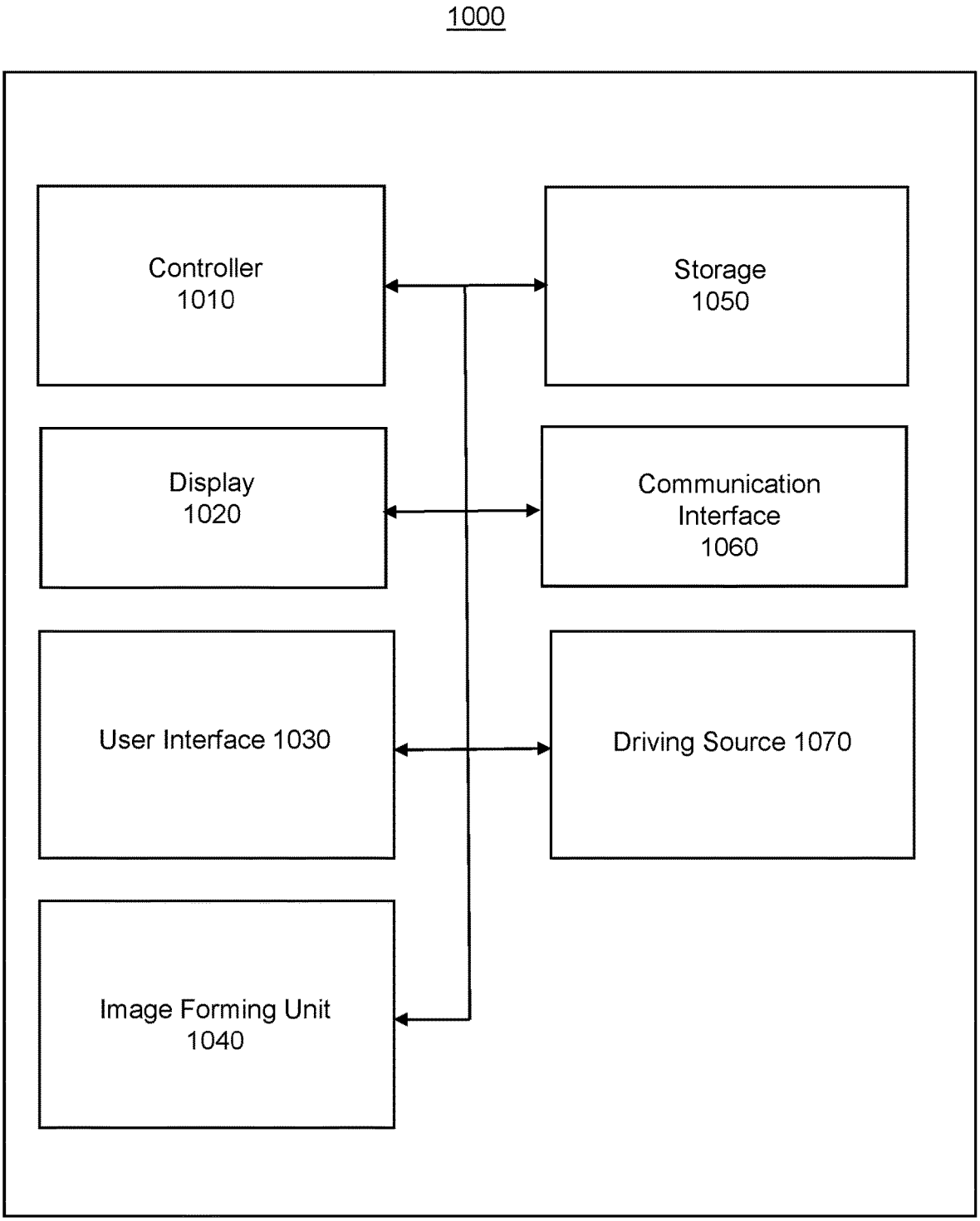
FIG. 7 is a block diagram of an image forming apparatus according to an example.

FIG. 7 is a block diagram of an image forming apparatus according to an example.

Referring to FIG. 7, the image forming apparatus 1000 may include some or all of the features shown in the image forming apparatuses illustrated in FIGS. 1 and 6. With reference to FIG. 7, the image forming apparatus 1000 includes a controller 1010, a display 1020, a user interface 1030, an image forming unit 1040, a storage 1050, a communication interface 1060, and a driving source 1070.

The controller 1010 may execute instructions stored in the storage 1050. The controller 1010 may include, for example, a processor, an arithmetic logic unit, a central processing unit (CPU), a graphics processing unit (GPU), a digital signal processor (DSP), an image processor, a microcomputer, a field programmable array, a programmable logic unit, an application-specific integrated circuit (ASIC), a microprocessor, or combinations thereof.

The display 1020 may display information regarding the image forming apparatus 1000. The display 1020 may include a liquid crystal display (LCD), a light emitting diode (LED) display, an organic light emitting diode (OLED) display, active matrix organic light emitting diode (AMOLED), flexible display, 3D display, a plasma display panel (PDP), a cathode ray tube (CRT) display, and the like, for example. The display 1020 may also include a touchscreen to receive the user input and therefore may also be utilized as a user interface.

The user interface 1030 may receive a user input to perform an operation or function of the image forming apparatus 1000, and may provide a user with information regarding the image forming apparatus 1000. The user interface 1030 may include, for example, a keyboard (e.g., a physical keyboard, virtual keyboard, etc.), a mouse, a joystick, a button, a switch, an electronic pen or stylus, a gesture recognition sensor (e.g., to recognize gestures of a user including movements of a body part), an input sound device or voice recognition sensor (e.g., a microphone to receive a voice command), a track ball, or combinations thereof. The user interface 1030 may further include a haptic device to provide haptic feedback to a user. The user interface 1030 may also include a touch screen, for example.

The image forming unit 1040 may perform an image forming job by forming an image on a recording medium to perform a job such as printing, copying, and faxing, for example. The image forming unit 1040 may include a print engine which receives a control signal from the controller 1010 to perform an image forming or printing operation. The image forming unit 1040 may include a development system including the development cartridge 2.

The storage 1050 may include, for example, machine readable storage devices which may be any electronic, magnetic, optical, or other physical storage device that stores executable instructions. For example, the storage 1050 may include a nonvolatile memory device, such as a Read Only Memory (ROM), Programmable Read Only Memory (PROM), Erasable Programmable Read Only Memory (EPROM), and flash memory, a USB drive, a volatile memory device such as a Random Access Memory (RAM), a hard disk, floppy disks, a blue-ray disk, or optical media such as CD ROM discs and DVDs, or combinations thereof.

The image forming apparatus 1000 may be connected with another device such as a laptop, personal computer, tablet, mobile phone, server, or combinations thereof, in a wired and/or wireless manner, for example through a communication interface 1060. The image forming apparatus 1000 may be connected over a network such as a local area network (LAN), wireless local area network (WLAN), wide area network (WAN), personal area network (PAN), virtual private network (VPN), or the like. For example, wireless communication between elements of the examples disclosed herein may be performed via a wireless LAN, Wi-Fi, Bluetooth, ZigBee, Wi-Fi direct (WFD), ultra wideband (UWB), infrared data association (IrDA), Bluetooth low energy (BLE), near field communication (NFC), a radio frequency (RF) signal, and the like. For example, the wired communication connection may be performed via a pair cable, a coaxial cable, an optical fiber cable, an Ethernet cable, and the like.

The driving source 1070 may be coupled directly or indirectly to a rotatable shaft to rotate a body, for example a roller of the image forming apparatus 1000. The driving source 1070 may include a motor, a solenoid, another electromechanical device, or combinations thereof. For example, the driving source 1070 may include a motor, a gear coupled to a rotatable shaft, and a driving belt coupling the motor to the gear to drive rotation of the rotatable shaft according to a signal output from the controller 1010. The rotatable shaft may be rotated in a first direction and a second direction by the driving source 1070. The first direction may be referred to as a "forward" direction and the second direction may be referred to as a "reverse" direction. A driving source may be provided to drive more than one body. For example, a single driving source may be provided to cause more than one body to move or rotate.

Figure 8:
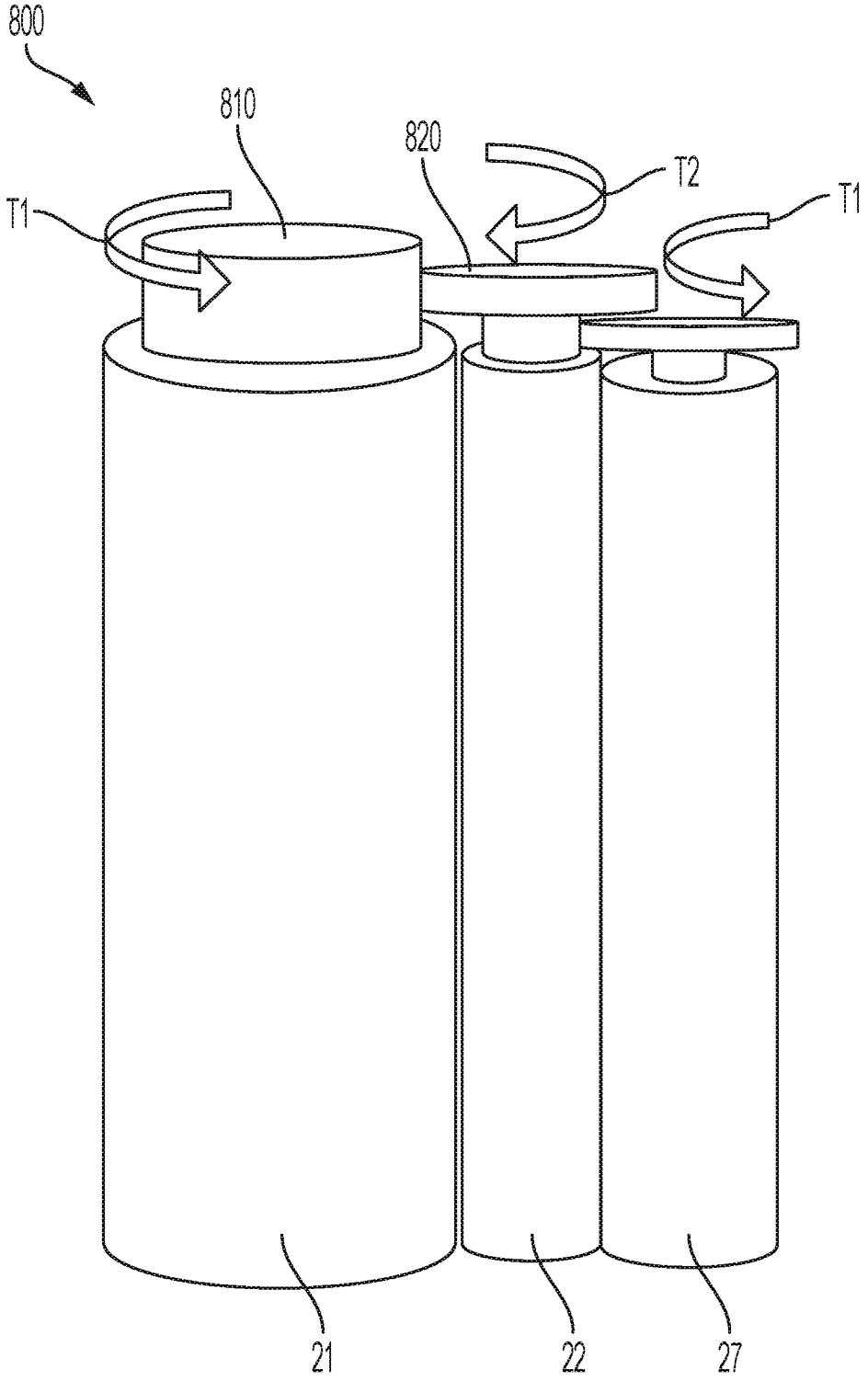
FIGS. 8 and 9 are illustrations of a development system in printing and alienation orientations, according to an example.
Figure 9:
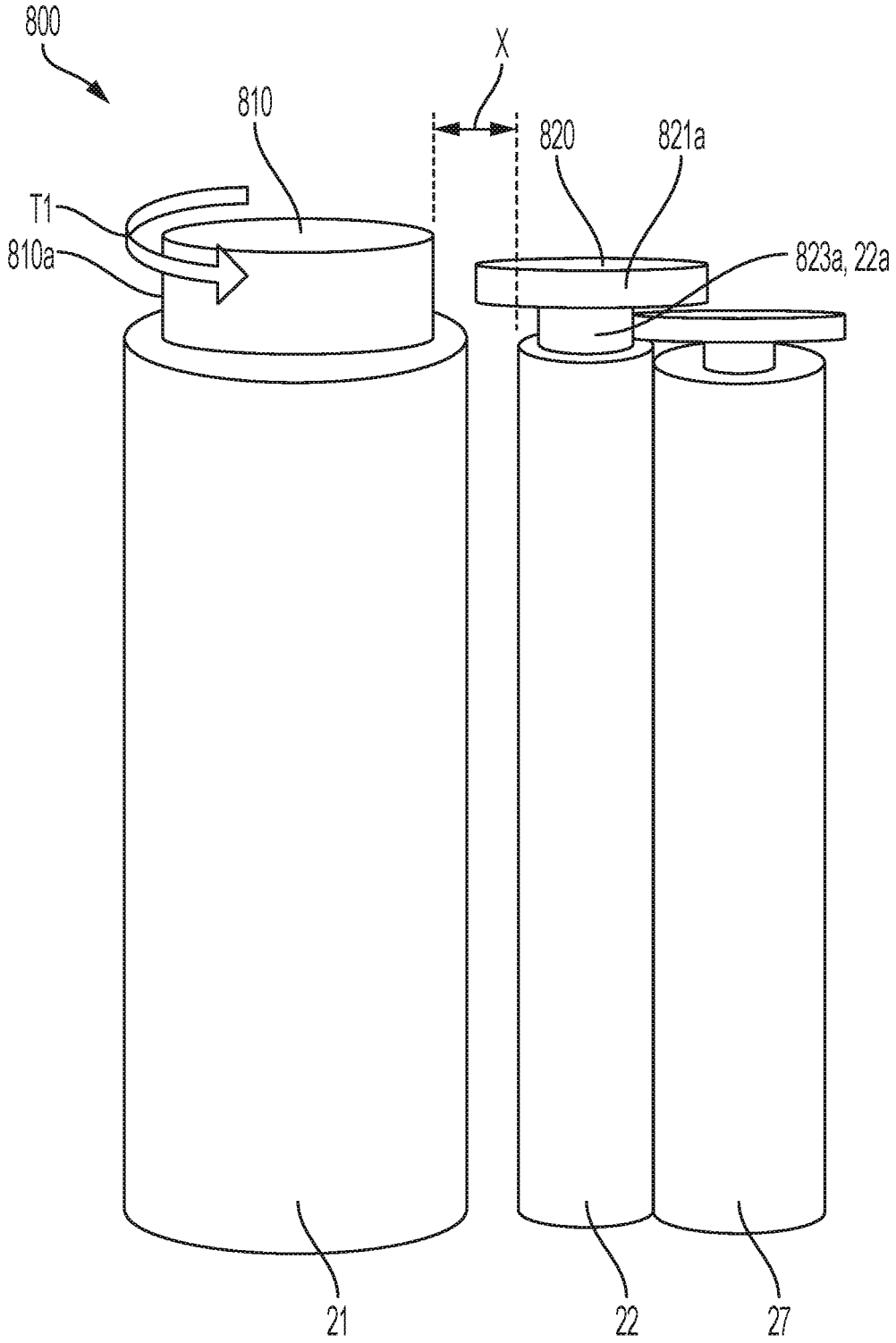

FIGS. 8 and 9 are illustrations of a development system in printing and alienation orientations, respectively, according to an example.

Referring to FIG. 8, a development system 800 is illustrated, including the photosensitive drum 21, developing roller, 22, and supply roller 27. The term photosensitive drum may be interchangeably used with the term photoconductor. In FIG. 8, the development system 800 is in the printing orientation, where the photosensitive drum 21 is in contact, for example frictional contact, with the developing roller 22. An image forming operation, for example, a printing operation, can be performed while the development system 800 is in the printing orientation. In FIG. 8 the developing roller 22 may be referred to as being in a printing or development or first position for performing an image forming operation such as printing, as discussed above with respect to the examples of FIGS. 2 through 5.

As illustrated in FIG. 8, at one end of the photosensitive drum 21, a drive plate 810 is provided. The drive plate 810 may receive a driving force to rotate the photosensitive drum 21, for example, as indicated in FIG. 8 in the direction T1. The driving force may be provided to the drive plate 810 according to a control signal from the controller 1010 to perform an image forming or printing operation. The drive plate 810 may receive the driving force from the driving source 1070, directly or indirectly. The drive plate 810 may have a cylinder shape and protrude from an end of the photosensitive drum 21. The drive plate 810 is connected to a rotational drive shaft of the photosensitive drum 21 to rotate the photosensitive drum 21.

As illustrated in FIG. 8, at one end of the developing roller 22 a clutch mechanism 820 is provided. The developing roller 22 may be driven by rotation of the photosensitive drum 21, for example, as indicated in FIG. 8 in the direction T2. The developing roller 22 may be driven by rotation of the photosensitive drum 21 by friction, and thus a separate driving source may not be provided for the developing roller 22 and a single driving source can be utilized to drive both the photosensitive drum 21 and the developing roller 22. The clutch mechanism 820 may also be in contact with or engage a portion of the drive plate 810 when the development system 800 is in the printing orientation. The clutch mechanism 820 serves to dampen a force generated when the clutch mechanism 820 engages the drive plate 810 of the photosensitive drum 21. As discussed above, the developing roller 22 is movable to a first position where the developing roller 22 is to receive a frictional driving force from the photosensitive drum 21 to rotate the developing roller 22, and movable to a second position where the developing roller 22 and photosensitive drum 21 are spaced apart from one another. The clutch mechanism 820 engages the drive plate 810 when the developing roller 22 is moved from the second position to the first position.

The supply roller 27 may be rotated in the direction T1 by rotation of the developing roller 22. The supply roller 27 may include gearing provided at an end of the supply roller 27 which interacts with gearing provided at an end of the developing roller 22 to transfer rotation forces from the developing roller 22 to the supply roller 27.

The clutch mechanism 820 is a low cost, compact, fully mechanical system which can be implemented in the development system 800 to prevent or reduce wear or damage to the development system 800.

As illustrated in FIG. 9, the development system 800 is in the alienation orientation and the developing roller 22 is spaced apart from the photosensitive drum, for example by a distance x. Thus, mechanical wear can be reduced or prevented with respect to the photosensitive drum 21 and developing roller 22. That is, if the photosensitive drum 21 and developing roller 22 are maintained in the printing orientation to form the development nip, over time the developing roller 22 may be deformed and the photosensitive drum 21 may be damaged. The deformation of the developing roller 22 and the damage to the photosensitive drum 21 may cause a change in the development nip and thus may reduce image quality. The reduction or prevention of mechanical wear by providing for the developing roller 22 to be spaced apart from the photosensitive drum 21, allows the developing roller 22 to keep its form and increase its lifetime to allow for more rotations of the developing roller 22. For example, when the photosensitive drum 21 is rotated while the developing roller 22 is in the second or alienation position, the developing roller 22 is not rotated by the friction force of the photosensitive drum 21. The development system 800 may be transitioned between the alienation orientation and printing orientation by using the example structures discussed above with respect to FIGS. 2 through 5, however these are merely examples and other structures may be implemented to transition the development system 800 between the alienation orientation and printing orientation.

The development system 800 may be further provided with the clutch mechanism 820 which may provide a smooth transition of the development system 800 between the alienation orientation and the printing orientation. For example, when the developing roller 22 is moved from the second position (alienation position) to the first position (development position), there may be an initial jarring reaction between the photosensitive drum 21 and the developing roller 21. The force generated by transitioning between the alienation orientation and the printing orientation may cause wear or damage to the photosensitive drum 21 and developing roller 22. To reduce or prevent such wear and damage, the clutch mechanism 820 dampens the force generated when the development system 800 transitions between the alienation orientation and the printing orientation.

Figure 10:
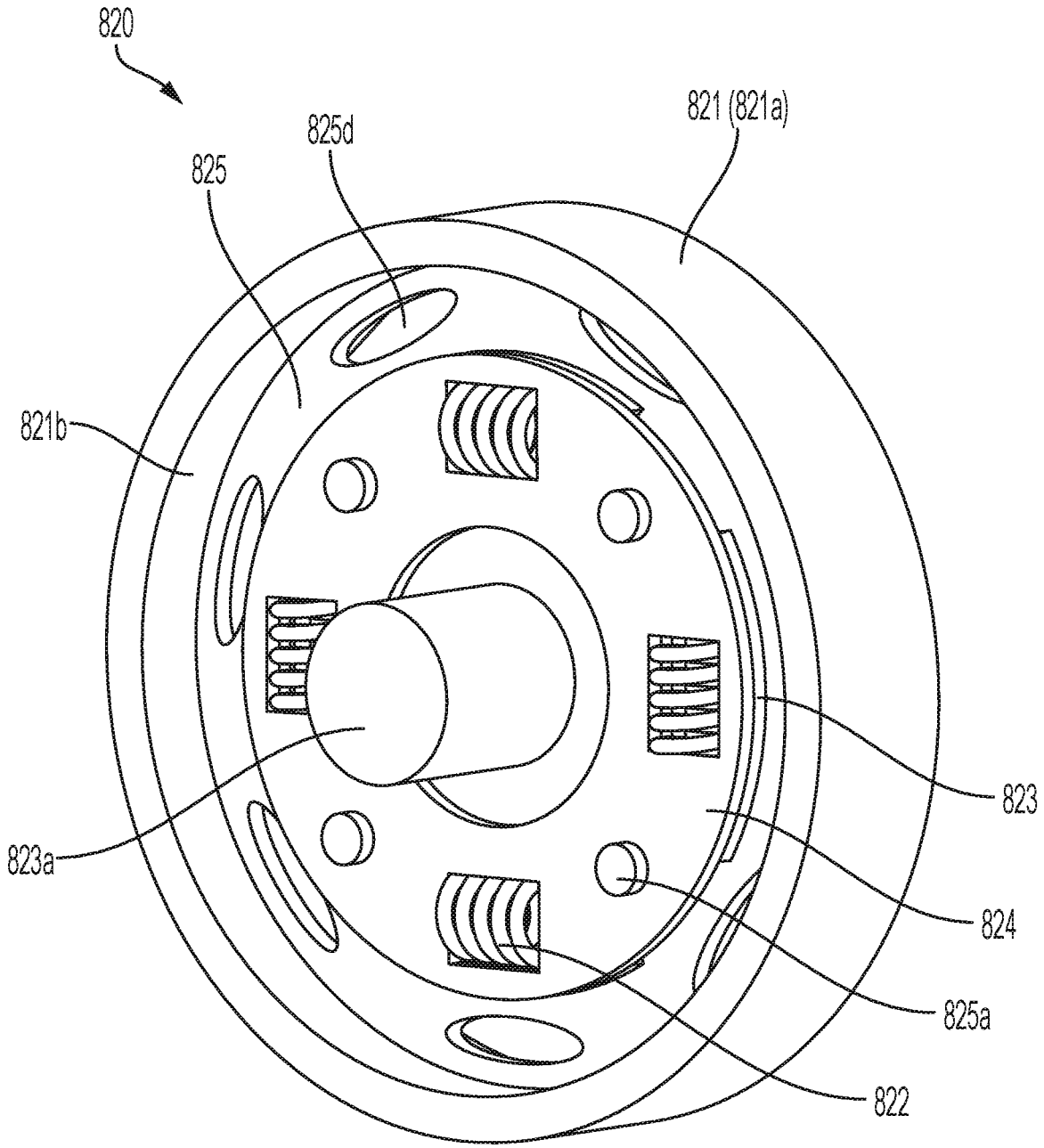
FIGS. 10 and 11 include a perspective view and a rear view of a clutch mechanism, respectively, according to an example.
Figure 11:
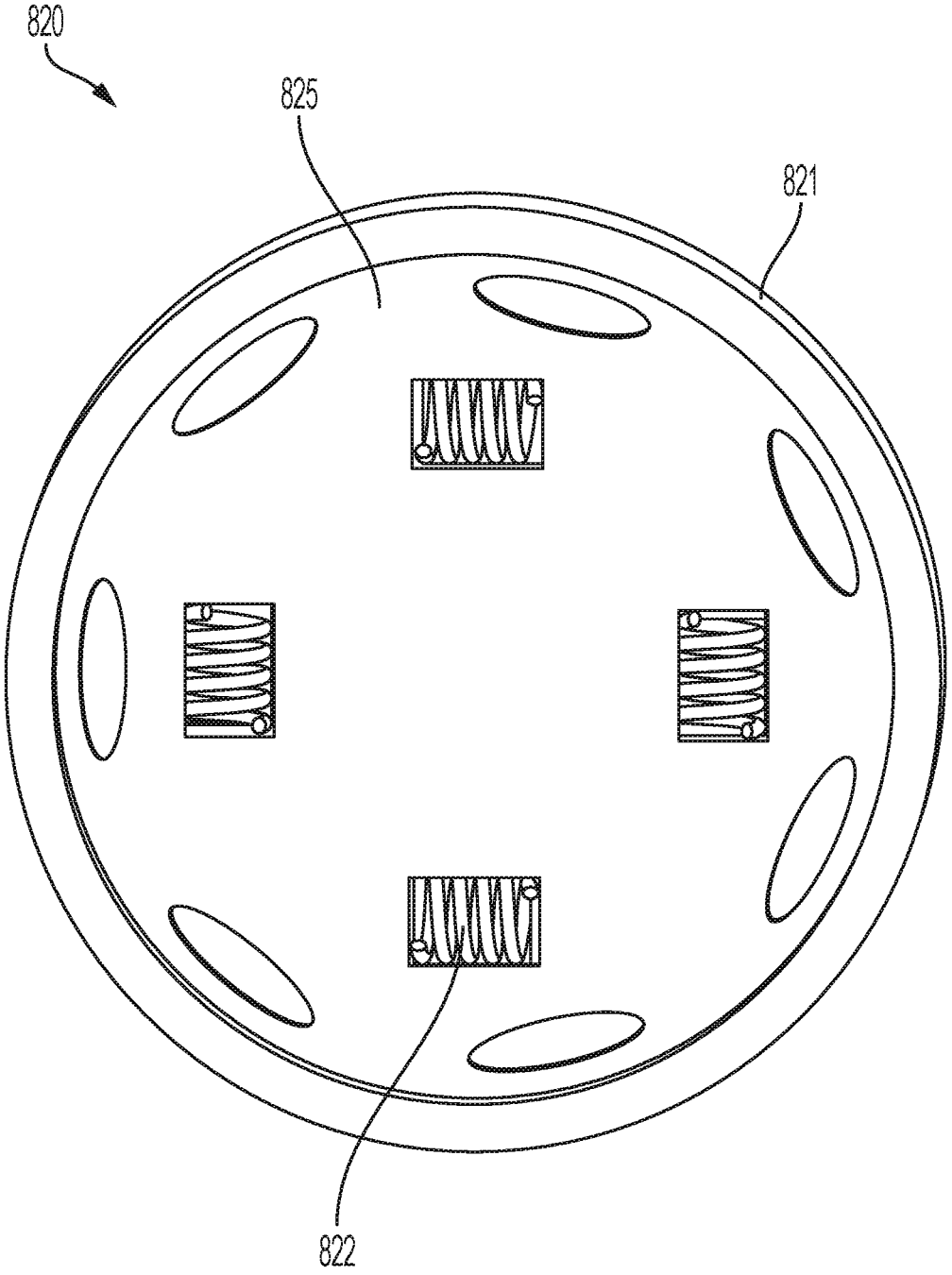
Figure 12:
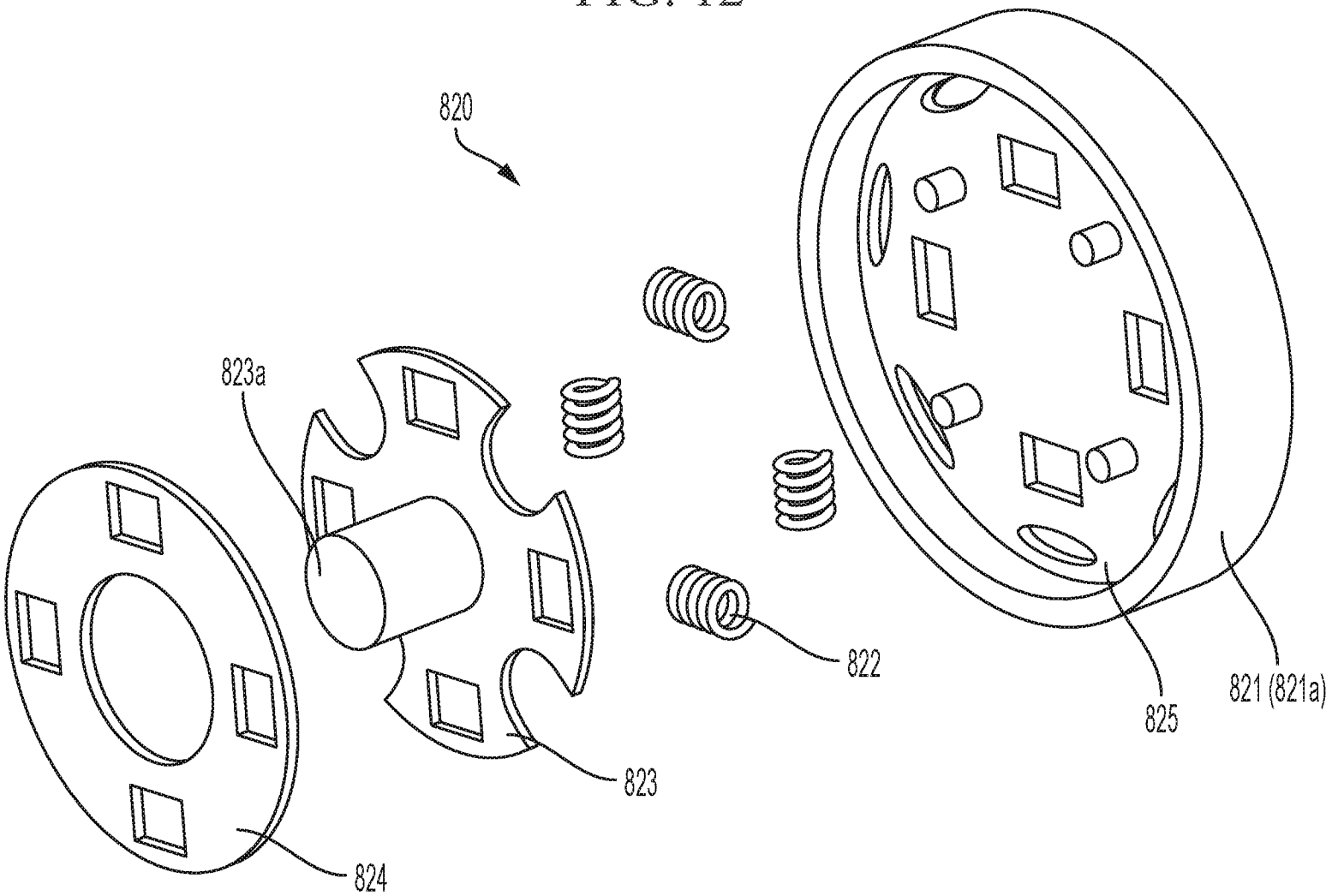
FIG. 12 is an exploded view of the clutch mechanism, according to an example.

Referring to FIGS. 10 and 11, a perspective view and a rear view of the clutch mechanism 820 are respectively shown, according to an example. FIG. 12 is an exploded view of the clutch mechanism 820, according to an example. The clutch mechanism 820 may include a friction plate 821, a plurality of urging members 822, a freewheel 823, a front plate 824, and an outer housing 825.

The friction plate 821 is a cylindrical ring-shaped member that has an outer circumferential surface 821*a* which contacts an outer circumferential surface 810*a* of the drive plate 810 when the development system 800 is in the printing orientation. The circumferential surface 821 of the friction plate 821 may have a rough, sandpaper like material, while the circumferential surface 810*a* of the drive plate 810 may have a rubber-like material. In another example, the circumferential surface 821 of the friction plate 821 may have a rubber like material, while the circumferential surface 810*a* of the drive plate 810 may have the rough, sandpaper like material. A coefficient of friction of the circumferential surface 821 of the friction plate 821 and the circumferential surface 810*a* of the drive plate 810 may be between about 0.5 and 1, to reduce or prevent slippage. The friction plate 821 can engage the drive plate 810 while the drive plate 810 is rotating, for example, when the developing roller 22 is moved from the second position to the first position, and the urging members 822 dampen the force generated when the friction plate 821 comes into contact with the drive plate 810 by pressing against a surface of the freewheel 823.

The friction plate 821 may be formed together as a single integral piece with the outer housing 825, which is provided on an interior circumferential surface 821*b* of the friction plate 821. A height of the friction plate 821 having the cylindrical shape may be about one-fourth to one-third of the diameter of the friction plate. A radius of the friction plate 821 may be determined in view of the width x that the developing roller 22 is spaced apart from the photosensitive drum 21, such that the friction plate 821 contacts the drive plate 810 at a same time that the developing roller 22 contacts the photosensitive drum 21. For example, the circumferential surface 821*a* of the friction plate 821 may engage a circumferential surface 810*a* of the drive plate 810 while the drive plate 810 is rotating, when the developing roller 22 is moved from the second position to the first position to contact the photosensitive drum 21. The diameter of the friction plate 821 is greater than a diameter of the developing roller 22. The diameter of the drive plate 810*a* is less than a diameter of the photosensitive drum 21.

Figure 13A:
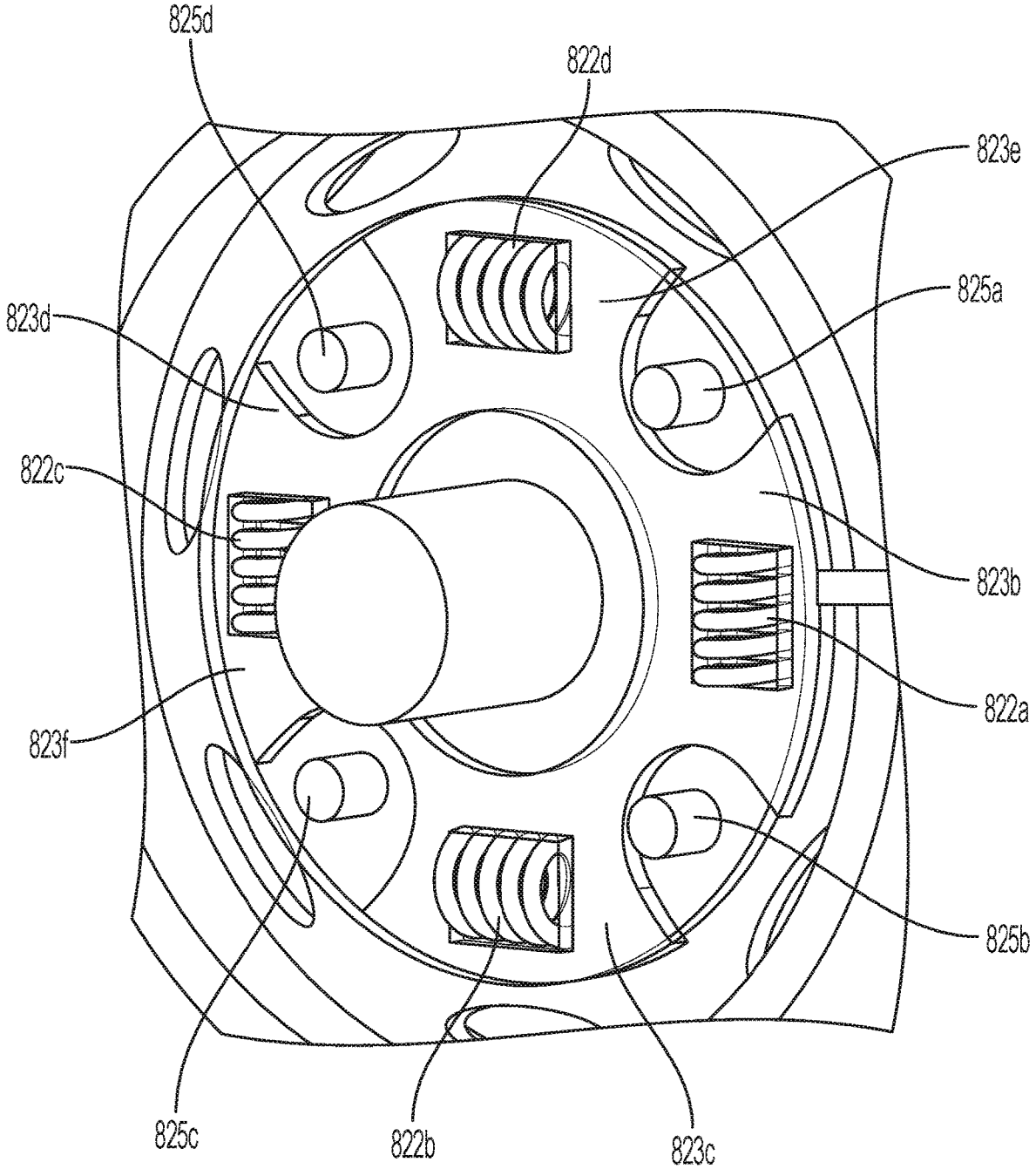
FIGS. 13A and 13B are perspective views of a portion of the clutch mechanism, according to an example.
Figure 13B:
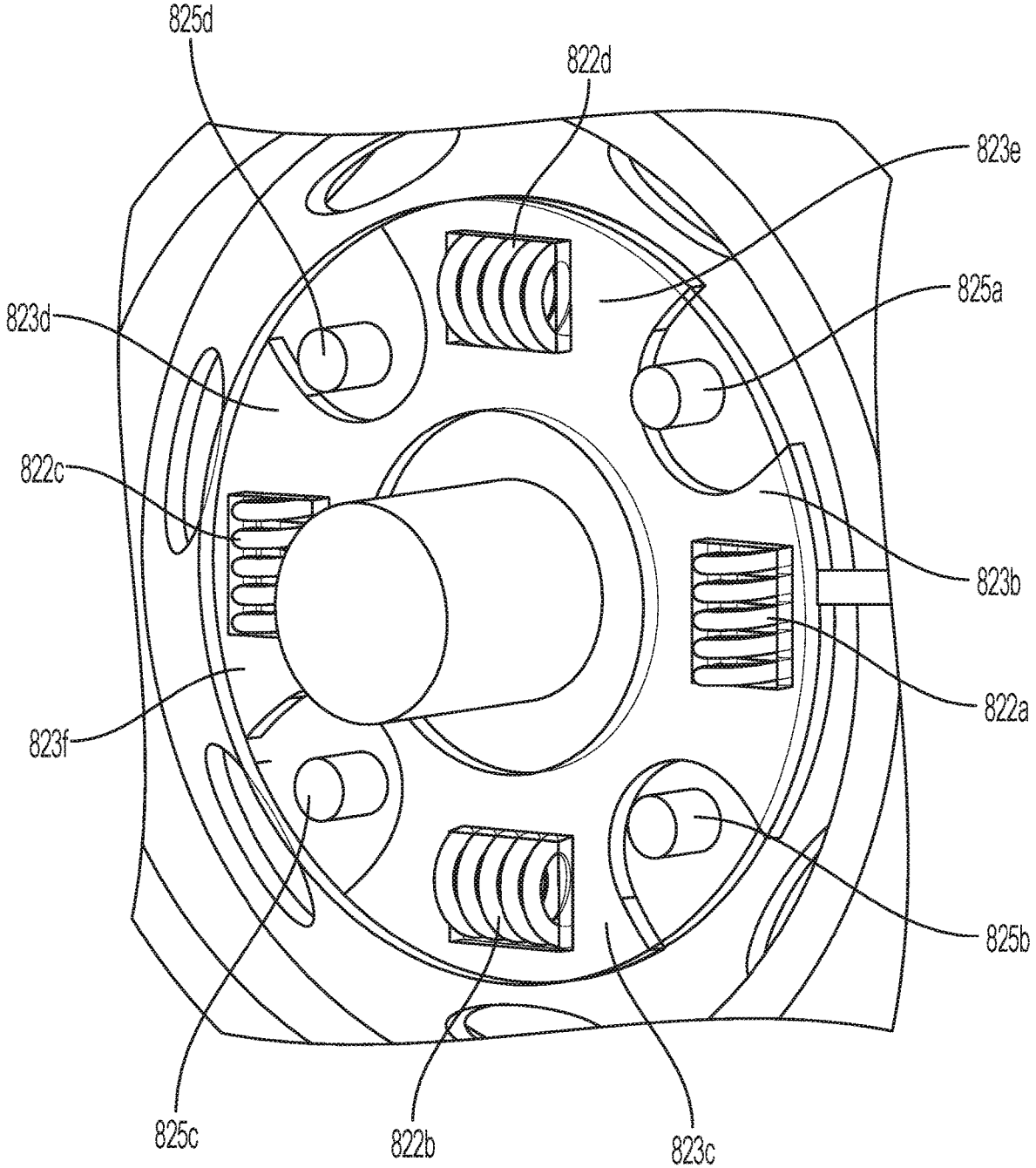

As shown in FIG. 12, the outer housing 825 includes a plurality of holes, which may be rectangular in shape, to accommodate the urging members 822. The holes may be of a same size as the holes provided in the freewheel 823 and front plate 824, which are also provided so as to accommodate the urging members 822. Elliptically-shaped holes 825*d* may also be provided in the outer housing 825 to reduce material usage. The shape and number of the holes 825*d* provided in the outer housing 825 may be varied. In FIGS. 10-12 there are seven holes 825*d* provided in the outer housing 825, however as stated above there may be less seven holes or more than seven holes. The outer housing 825 includes bolts, which may be provided circumferentially about the outer housing 825, and may be used to secure the front plate 824 to the outer housing 825, with the freewheel 823 disposed between the front plate 824 and the outer housing 825. In FIGS. 13A-13B the outer housing 825 includes four bolts 825*a*-825*d*, however there may be more than four bolts or less than four bolts. The bolts 825*a*-825*d* may be provided in the outer housing 825 between the holes in which the urging members are provided.

The clutch mechanism 820 may include a plurality of urging members 822 which are provided on an interior side of the friction plate 821. For example, the clutch mechanism 820 may include two to six urging members 822 which are arranged to be spaced apart from one another circumferentially about a center of the clutch mechanism 820. In FIGS. 13A-13B, four urging members 822*a*-822*d* are illustrated. The urging members 822 may be of the same size or different size than one another. The urging members 822 may be springs, for example. The springs may be straight, or may be bent to be arc-shaped for example. Although not shown, additional urging members may be provided at a further interior portion of the clutch mechanism 820, that is, closer to the center of the clutch mechanism than the urging members 822 depicted in FIG. 10. The additional urging members provided closer to the center may be of a smaller size than the urging members provided farther from the center. These additional urging members can provide additional dampening forces when the development system is transitioned from the alienation orientation to the printing orientation.

The freewheel 823 may be disposed between the front plate 824 and the outer housing 825. The freewheel 823 may be shaped to have a cross-shape with a cylindrical protrusion 823*a* which protrudes from a center of the freewheel 823. The freewheel 823 may rotate when the rotational drive shaft 22*a* of the developing roller 22 is rotated.

The front plate 824 may be disposed on one side of the freewheel 823 and the outer housing 825, at a side closer to the developing roller 22 relative to the freewheel 823 and the outer housing 825. The front plate 824 may include holes or windows to accommodate the urging members 822 and holes or windows through which bolts of the outer housing 825 are inserted so as to connect the front plate 824 to the outer housing 825. In FIG. 12, the holes through which bolts 825*a*-825*d* are to be inserted are not shown.

FIGS. 13A-13B are views of a portion of the clutch mechanism 820, according to an example. In FIGS. 13A-13B, the front plate 824 is omitted for purposes of clarity to depict the freewheel 823. In FIG. 13A the freewheel 823 is in an initial position, while in FIG. 13B the freewheel 823 has been rotated a certain or predetermined amount due to a rotational force applied to the rotational drive shaft 22*a* of the developing roller 22, such that the urging members 822*a*-822*d* contact or press against an interior surface of a hole or window of the freewheel 823 in which the urging members 822*a*-822*d* are correspondingly provided. The urging members 822*a*-822*d* may also contact or press against an interior surface of a hole or window of the front plate 824 and of a hole or window of the outer housing 825 in which the urging members 822*a*-822*d* are correspondingly provided. Because the urging members 822*a*-822*d* provide a resistive or dampening force, an initial force generated by the engagement of the developing roller 22 with the photosensitive drum 21 can be decreased.

As illustrated in FIGS. 13A-13B, the freewheel 823 may include arms 823*b*, 823*c*, 823*d*, and 823*e*. Each of the arms 823*b*, 823*c*, 823*d*, and 823*e* may have straight or curved edges. In FIGS. 13A-13B, the arms 823*b*, 823*c*, 823*d*, and 823*e* are curved. Between each of the arms 823*b*, 823*c*, 823*d*, and 823*e* a space may be formed in which a corresponding bolt 825*a*, 825*b*, 825*c*, and 825*d* of the outer housing 825 is provided. In FIGS. 13A-13B, the space between each of the arms is substantially u-shaped or v-shaped, however the disclosure is not so limited and the space may be differently shaped, for example, rectangular-shaped. Each bolt 825*a*, 825*b*, 825*c*, and 825*d* of the outer housing 825 may be inserted through a corresponding hole or gap provided in the front plate 824 and the front plate 824 may be secured to the outer housing 825. Also in FIGS. 13A-13B, a substantially rectangular hole is provided in an outer center of each of the arms in which a corresponding urging member 822*a*, 822*b*, 822*c*, and 822*d* is provided. Likewise, a corresponding hole is provided in the front plate 824 to accommodate each corresponding urging member 822*a*, 822*b*, 822*c*, and 822*d*.

The cylindrical protrusion 823*a* may be connected to the rotational drive shaft 22*a* of the developing roller 22 so that when the developing roller 22 is rotated, the clutch mechanism 820 is also rotated via the connection of the cylindrical protrusion 823*a* to the rotational drive shaft 22*a* of the developing roller 22. As illustrated in FIGS. 13A-13B, when the developing roller 22 is rotated the freewheel 823 is also rotated, and the urging members 822*a*-822*d* provides a dampening force by pressing against a portion of the freewheel. For example, as illustrated in FIGS. 13A-13B, when freewheel 823 is rotated in a clockwise direction, urging member 822*c* comes into contact with an interior wall 823*f* of the rectangular hole of the freewheel 823 in which urging member 822*c* is provided, so as to provide the dampening force. The urging member 822*c* may be compressed and provide a force in a direction opposite to a direction of the rotation of the freewheel 823 to provide the dampening force. Urging members 822*a*, 822*b*, and 822*d* also provide a dampening force in a manner similar to that described above with respect to urging member 822*c*. As discussed above, the urging members 822*a*-822*d* may contact or press against an interior surface of a hole or window provided in the free wheel 823, front plate 824, and outer housing 825, in which the urging members 822*a*-822*d* are correspondingly provided, to provide the dampening force.

As mentioned above, the cylindrical protrusion 823*a* may be connected to the rotational drive shaft 22*a* of the developing roller 22. A height of the cylindrical protrusion 823*a* may be greater than a height of the friction plate 821. For example, the cylindrical protrusion 823*a* may be connected or secured to the rotational drive shaft 22*a* of the developing roller 22 by an adhesive such as glue, a fastener such as a screw, and the like. As another example, the cylindrical protrusion 823*a* may be connected or secured to the rotational drive shaft 22*a* of the developing roller 22 by having a hollow portion to which the rotational drive shaft 22*a* of the developing roller 22 is inserted and secured, or vice versa.

In another example, the cylindrical protrusion 823*a* may be omitted and the rotational drive shaft 22*a* of the developing roller 22 may be directly connected to the freewheel 823 of the clutch mechanism 820. That is, the rotational drive shaft 22*a* of the developing roller 22 and the cylindrical protrusion 823*a* may be formed as a single integral piece to which the freewheel 823 (less the cylindrical protrusion 823*a* now integrally formed with the rotational drive shaft 22*a*) is mounted or connected to. As another example, the rotational drive shaft 22*a* of the developing roller 22, the cylindrical protrusion 823*a*, and the freewheel 823, may be formed as a single integral piece to which the front plate 824 and outer housing 825 are mounted or connected to.

According to the examples described herein, the development system 800 includes a photosensitive drum 21 and developing roller 22 which can be provided in a printing orientation where friction contact between the developing roller 22 and photosensitive drum 21 transfers a rotation force to the developing roller 22, and an alienation orientation where the photosensitive drum 21 and developing roller 22 are separated from one another. Urging member forces are generated by a clutch mechanism 820, which includes a friction plate 821 and urging members 822, to dampen the initial transition between the alienation and printing orientations. This allows for a smooth transition between the two orientations to reduce or prevent wear and damage to the developing roller 22 and photosensitive drum 21. For example, as a stationary friction plate 821 comes into contact with a rotating drive plate 810, the urging members 822 absorb the initial force generated by the engagement of the clutch mechanism 820 with the drive plate 810 and the developing roller 22 and the photosensitive drum 21. The clutch mechanism 820 allows or assists in keeping the transition smooth for the developing roller 22 and the photosensitive drum 21 when moving from the alienation orientation to the printing orientation.

In the above examples, the clutch mechanism 820 is described as being applied to an end of the developing roller 22. However, the disclosure is not so limited and other applications are within the scope of the disclosure. For example, the clutch mechanism 820 may be applied to an end of the supply roller 27 in a like manner as the clutch mechanism 820 is applied to an end of the developing roller 22, and the friction plate may contact a portion of the developing roller 22. For example, in a case where the supply roller 27 is driven by a separate driving source, the supply roller 27 may be selectively separated from the developing roller 22 to be in an alienation position. When the supply roller 27 is brought into contact with the developing roller 22 from the alienation position to a supply position to supply toner to the developing roller 22, the clutch mechanism 820 may dampen a force generated when the clutch mechanism 820 provided at an end of the supply roller 27 engages a portion of the developing roller 22.

While this disclosure has been shown and described with reference to examples thereof, it will be understood by one of ordinary skill in the art that various changes in form and details may be made therein without departing from the spirit and scope as defined by the appended claims.

What is claimed is:

1. A development system, comprising:

a photosensitive drum having a drive plate to receive a driving force to rotate the photosensitive drum, the drive plate being provided on an end of the photosensitive drum; and a developing roller having a clutch mechanism to dampen a force generated when the clutch mechanism engages the drive plate of the photosensitive drum, the clutch mechanism being provided on an end of the developing roller.

2. The development system of claim 1, wherein the developing roller is movable to a first position where the developing roller is to receive a frictional driving force from the photosensitive drum to rotate the developing roller, and movable to a second position where the developing roller and photosensitive drum are spaced apart from one another, and the clutch mechanism is to engage the drive plate when the developing roller is moved from the second position to the first position.

3. The development system of claim 2, wherein the clutch mechanism includes:

a friction plate to engage the drive plate while the drive plate is rotating, when the developing roller is moved from the second position to the first position, and an urging member to dampen the force generated when the friction plate comes into contact with the drive plate.

4. The development system of claim 3, wherein the friction plate and drive plate each have a cylindrical shape, the urging member is provided on an interior side of the friction plate, and a circumferential surface of the friction plate is to engage a circumferential surface of the drive plate while the drive plate is rotating, when the developing roller is moved from the second position to the first position.

5. The development system of claim 3, wherein the urging member includes a plurality of springs.

6. The development system of claim 5, wherein the plurality of springs are spaced apart from one another in a circumferential direction of the developing roller.

7. The development system of claim 1, wherein the clutch mechanism is connected to a rotational drive shaft of the developer roller and is to rotate together with the developer roller.

8. The development system of claim 1, wherein the photosensitive drum and developing roller are driven by a single driving source.

9. An image forming apparatus, comprising:

a main body;

a development system provided in the main body, the development system including:

a photosensitive drum having a drive plate to receive a driving force to rotate the photosensitive drum, the drive plate being provided on an end of the photosensitive drum; and a developing roller having a clutch mechanism to dampen a force generated when the clutch mechanism engages the drive plate of the photosensitive drum, the clutch mechanism being provided on an end of the developing roller.

10. The image forming apparatus of claim 9, wherein the developing roller is movable to a first position where the developing roller is to receive a frictional driving force from the photosensitive drum to rotate the developing roller, and movable to a second position where the developing roller and photosensitive drum are spaced apart from one another, and the clutch mechanism is to engage the drive plate when the developing roller is moved from the second position to the first position.

11. The image forming apparatus of claim 10, wherein the clutch mechanism includes:

a friction plate to engage the drive plate while the drive plate is rotating, when the developing roller is moved from the second position to the first position, and an urging member to dampen the force generated when the friction plate comes into contact with the drive plate.

12. The image forming apparatus of claim 11, wherein the friction plate and drive plate each have a cylindrical shape, the urging member is provided on an interior side of the friction plate, and a circumferential surface of the friction plate is to engage a circumferential surface of the drive plate while the drive plate is rotating, when the developing roller is moved from the second position to the first position.

13. The image forming apparatus of claim 11, wherein the urging member includes a plurality of urging members spaced apart from one another in a circumferential direction of the developing roller, and each urging member is a spring.

14. The image forming apparatus of claim 9, further comprising a driving source to drive the photosensitive drum, and wherein the developing roller is driven by friction contact with the photosensitive drum when the developing roller is in contact with the photosensitive drum and the photosensitive drum is driven by the driving source.

15. The image forming apparatus of claim 9, wherein the clutch mechanism is connected to a roller drive shaft of the developer roller and is to rotate together with the developer roller.

* * * * *